US009795230B2

(12) United States Patent
Martell et al.

(10) Patent No.: US 9,795,230 B2
(45) Date of Patent: Oct. 24, 2017

(54) MODULAR DISPLAY UNIT

(71) Applicant: Target Brands, Inc., Minneapolis, MN (US)

(72) Inventors: Timothy J. Martell, Brooklyn Park, MN (US); Jeremy A. Clark, Minneapolis, MN (US); Jason W. Johnson, Wayzata, MN (US)

(73) Assignee: Target Brands, Inc., Minneapolis, MN (US)

( * ) Notice: Subject to any disclaimer, the term of this patent is extended or adjusted under 35 U.S.C. 154(b) by 365 days.

(21) Appl. No.: 14/486,180

(22) Filed: Sep. 15, 2014

(65) Prior Publication Data

US 2016/0073794 A1 Mar. 17, 2016

(51) Int. Cl.

| | |
|---|---|
| ***A41H 5/00*** | (2006.01) |
| ***A47F 5/16*** | (2006.01) |
| ***A47B 87/00*** | (2006.01) |
| *A47F 8/00* | (2006.01) |

(52) U.S. Cl.

CPC ..... *A47F 5/16* (2013.01); *A47B 87/008* (2013.01); *A47F 8/00* (2013.01)

(58) Field of Classification Search

CPC ... A47F 5/16; A47F 8/00; A47B 87/00; A47B 87/007; A47B 87/008

USPC ..... 220/23.4–23.6; 223/120

See application file for complete search history.

(56) References Cited

U.S. PATENT DOCUMENTS

| | | | | |
|---|---|---|---|---|
| 3,103,278 | A * | 9/1963 | Kuzma | B65D 21/0235 206/433 |
| 3,316,041 | A | 4/1967 | Nelson | |
| 3,563,624 | A | 2/1971 | Stice | |
| 3,768,637 | A * | 10/1973 | Whang | A47F 5/10 206/736 |
| 3,773,329 | A * | 11/1973 | Secter | A63F 9/088 273/153 R |
| 3,941,247 | A | 3/1976 | Cripe | |
| 3,944,281 | A * | 3/1976 | Piretti | A47B 87/00 297/248 |

(Continued)

OTHER PUBLICATIONS

Office Action from Canadian Patent Application No. 2,872,425, dated Mar. 2, 2015 (4 pages).

(Continued)

*Primary Examiner* — Nathan Durham

(74) *Attorney, Agent, or Firm* — Leanne Taveggia Farrell; Westman, Champlin & Koehler, P.A.

(57) ABSTRACT

A display unit includes an upper component that has a top panel, four side panels having bottom edges, exterior surfaces and interior surfaces that define a hollow interior. A base frame includes a lower portion having an outer periphery and an upper portion that extends upwardly from a top of the lower portion and has an outer periphery. Four corner members are coupled to and extend inwardly from the interior surfaces of the upper component and are positioned at a distance from the bottom edges of the four side panels. The four corner members engage with a top of the upper portion of the base frame such that the bottom edges of the four side panels of the upper component are spaced apart from the top of the lower portion of the base frame to expose a section of the upper portion of the base frame.

18 Claims, 14 Drawing Sheets

(56) References Cited

U.S. PATENT DOCUMENTS

| | | | | |
|---|---|---|---|---|
| 4,050,605 | A * | 9/1977 | Wakana | B65D 90/08 220/4.12 |
| 4,136,623 | A | 1/1979 | Dickson | |
| 4,560,257 | A | 12/1985 | Otema | |
| D290,204 | S | 6/1987 | Bruget | |
| D294,090 | S | 2/1988 | Robertson | |
| D300,289 | S | 3/1989 | Walter | |
| 4,903,451 | A | 2/1990 | Gresswell | |
| D307,718 | S | 5/1990 | Tabler | |
| D334,495 | S | 4/1993 | Bustos | |
| D336,803 | S | 6/1993 | Stoddard et al. | |
| D434,929 | S | 12/2000 | Heiny et al. | |
| D488,653 | S | 4/2004 | Ruff | |
| D499,589 | S | 12/2004 | Ruff | |
| 6,877,824 | B2 | 4/2005 | Winkless | |
| D538,088 | S | 3/2007 | Ruff | |
| 7,296,372 | B2 | 11/2007 | Clark et al. | |
| 7,478,732 | B2 | 1/2009 | Brownfield et al. | |
| D607,670 | S | 1/2010 | Trinh et al. | |
| 7,661,214 | B2 | 2/2010 | Clark et al. | |
| D613,980 | S | 4/2010 | Bucholz et al. | |
| 7,900,385 | B2 | 3/2011 | Clark et al. | |
| 7,922,492 | B2 | 4/2011 | Nielsen et al. | |
| D642,824 | S | 8/2011 | Theisen et al. | |
| 7,988,244 | B2 | 8/2011 | Haws, Jr. | |
| D648,548 | S | 11/2011 | Winer et al. | |
| 8,113,600 | B2 | 2/2012 | Zalewski et al. | |
| D670,111 | S | 11/2012 | McNamara | |
| D671,334 | S | 11/2012 | Levi et al. | |
| 8,312,610 | B2 | 11/2012 | Clark et al. | |
| D677,076 | S | 3/2013 | Olson | |
| D688,494 | S | 8/2013 | Hamm et al. | |
| 8,573,716 | B2 | 11/2013 | Zalewski | |
| D708,672 | S | 7/2014 | Denby et al. | |
| D718,560 | S | 12/2014 | Denby et al. | |
| D722,242 | S | 2/2015 | Feldman et al. | |
| D730,662 | S | 6/2015 | Trinh et al. | |
| 2002/0084726 | A1 | 7/2002 | O'Neill et al. | |
| 2007/0007865 | A1 | 1/2007 | Kang | |
| 2007/0181515 | A1 | 8/2007 | Levi et al. | |
| 2011/0179979 | A1 | 7/2011 | Nielsen et al. | |
| 2014/0252047 | A1 | 9/2014 | Clark et al. | |

OTHER PUBLICATIONS

Pending U.S. Appl. No. 29/502,317, filed Sep. 15, 2014, entitled Display Unit, 22 pages.

Pending U.S. Appl. No. 29/502,318, filed Sep. 15, 2014, entitled Display Unit, 20 pages.

Pending U.S. Appl. No. 29/502,320, filed Sep. 15, 2014, entitled Display Unit, 9 pages.

Pending U.S. Appl. No. 29/502,321, filed Sep. 15, 2014, entitled Display Unit, 13 pages.

Pending U.S. Appl. No. 29/502,322, filed Sep. 15, 2014, entitled Display Unit, 24 pages.

* cited by examiner

MODULAR DISPLAY UNIT

BACKGROUND

In retail stores, certain merchandise may need to be presented in a different way than on horizontal shelving or on hanging racks. For example, mannequins display clothing and should be placed on top of platforms for ease of viewing. The discussion above is merely provided for general background information and is not intended to be used as an aid in determining the scope of the claimed subject matter.

SUMMARY

A display unit includes an upper component that has a top panel, four side panels having bottom edges that define an opening in a bottom of the upper component, interior surfaces that define a hollow interior and exterior surfaces. A base frame includes a lower portion having an outer periphery and an upper portion that extends upwardly from a top of the lower portion and has an outer periphery. Four corner members are coupled to and extend inwardly from the interior surfaces of the upper component and are positioned at a distance from the bottom edges of the four side panels. The four corner members engage with a top of the upper portion of the base frame such that the bottom edges of the four side panels of the upper component are spaced apart from the top of the lower portion of the base frame to expose a section of the outer periphery of the upper portion of the base frame.

A display fixture includes a plurality of substantially identical box assemblies attached together to form an elevated runway for displaying mannequins. Each box assembly has a cover that includes a top wall, four side walls having bottom edges that define an opening in a bottom of the cover and a hollow interior. A four-sided pedestal has a base portion and a protruding portion. The protruding portion supports the cover so that the cover is separated from the base portion of the four-sided pedestal by a space. Each box assembly is attached to at least one other box assembly using at least one fastener that is inserted into at least one hole located in the space between the cover and the four-sided pedestal of each box assembly.

A method of displaying mannequins includes locating a plurality of four-sided pedestals adjacent to each other so that a side of one of the four-sided pedestals is adjacent to a side of another four-side pedestal. Each of the four-sided pedestals include a lower portion having an outer periphery and an upper portion that extends upwardly from a top of the lower portion and has an outer periphery. The plurality of four-sided pedestals are fastened together using fasteners that are inserted into holes located in a section of the upper portion of each four-sided pedestal. A plurality of covers are placed on top of the plurality of four-sided pedestals to form a runway. Each cover includes a top wall, four side walls having bottom edges that define an opening in a bottom of the cover and a hollow interior. Each four-sided pedestal supports one of the covers so that each cover is spaced apart from the lower portion of each four-sided pedestal by a distance. The distance is the section of the upper portion of each four-side pedestal that includes the holes for the fasteners.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The display unit described in detail below is a modular display unit that can be used to support and elevate display items, such as one or more mannequins. For example, mannequins can display particular merchandise including, but not limited to, clothing and accessories. The modular display unit includes a base frame and a cover supported by the base frame. The cover is spaced apart from a bottom portion of the base frame by a distance. The display unit can be attached to other like display units to form an elevated runway for displaying more display items or mannequins. The display units are attached to each other by passing fasteners through holes in the adjacent base frames that are located in the distance between the cover and the bottom portion of the base frame. In this way, the holes are hidden or blocked from view because the upper portion of the base frame is recessed from the outer periphery of the cover and the outer periphery of the bottom portion of the base frame. The display units can be used individually or in multiples without unused holes detracting from the overall display.

Figure 1:
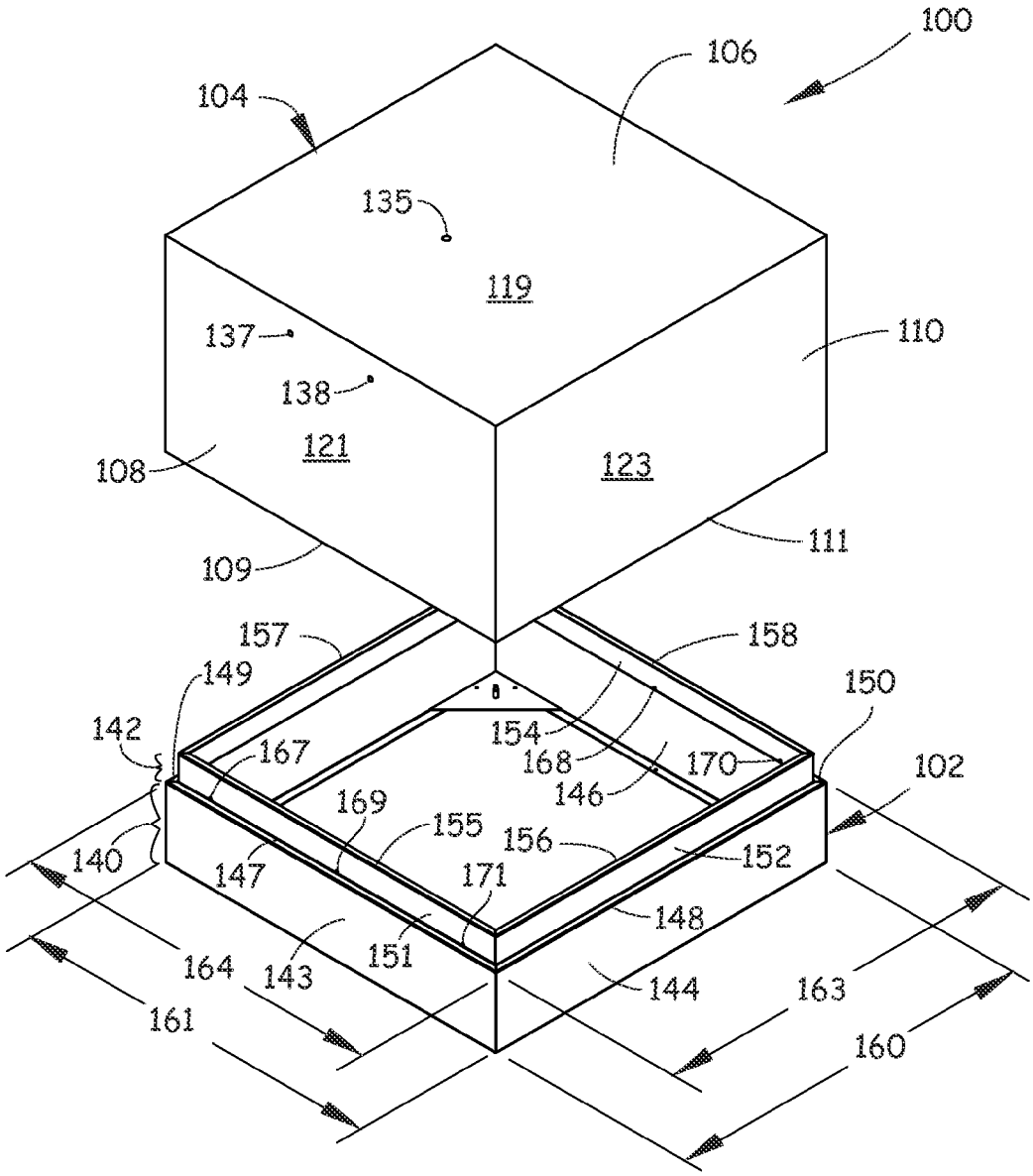
FIG. 1 is an exploded perspective view of a display unit according to one embodiment.
Figure 2:
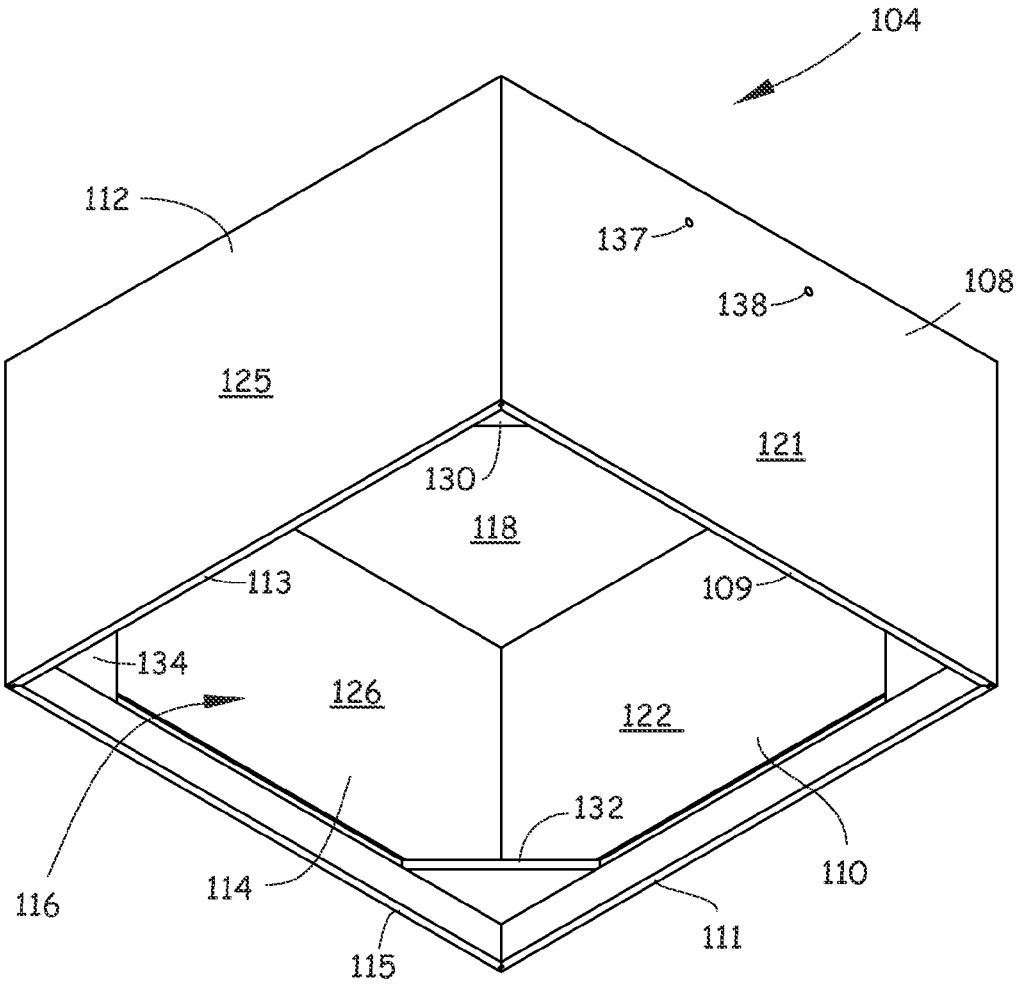
FIG. 2 is a bottom perspective view of the upper component or cover of the display unit illustrated in FIG. 1.
Figure 3:
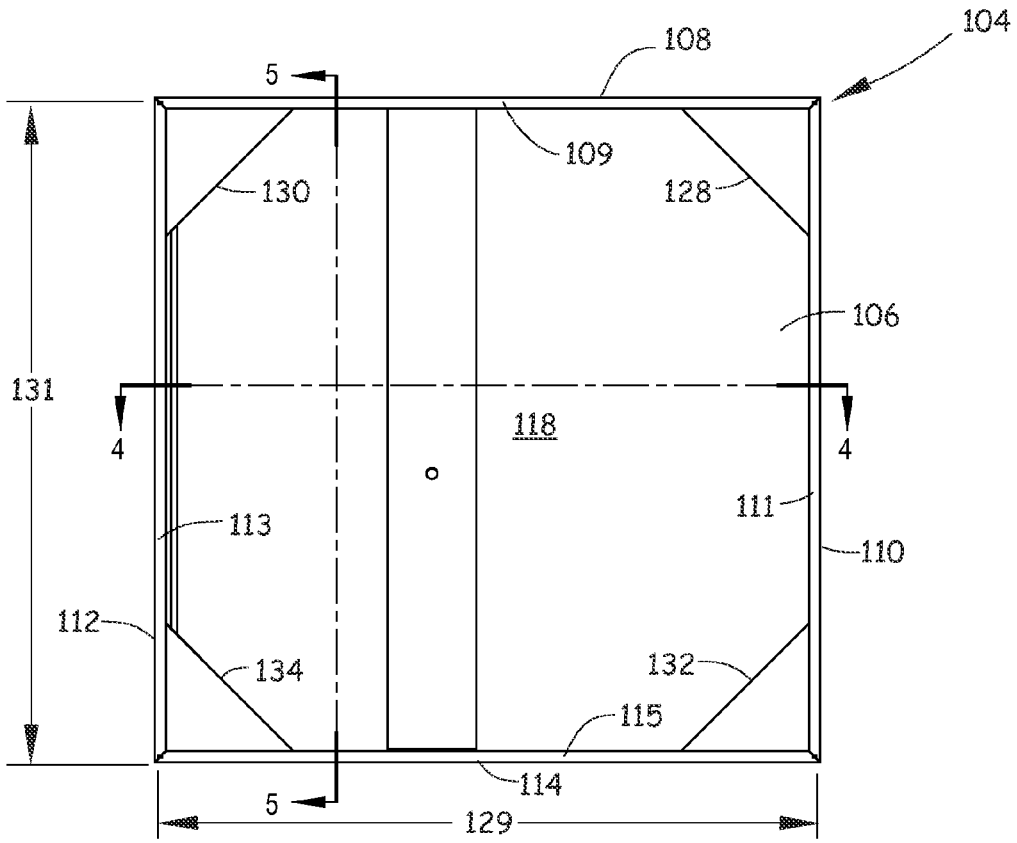
FIG. 3 is a bottom view of FIG. 2.
Figure 4:
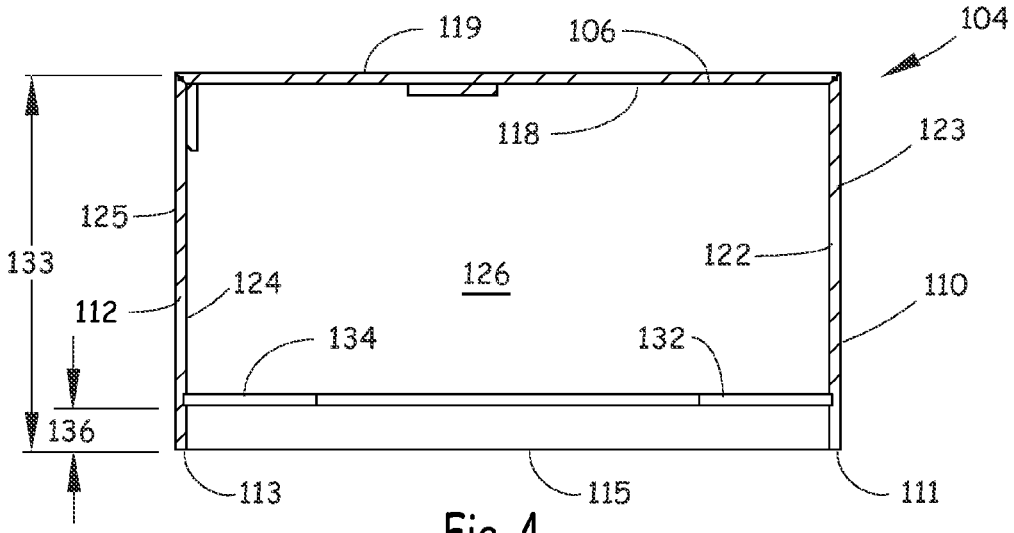
FIG. 4 is a first section view of the upper component or cover of the display unit taken through the line indicated in FIG. 3.
Figure 5:
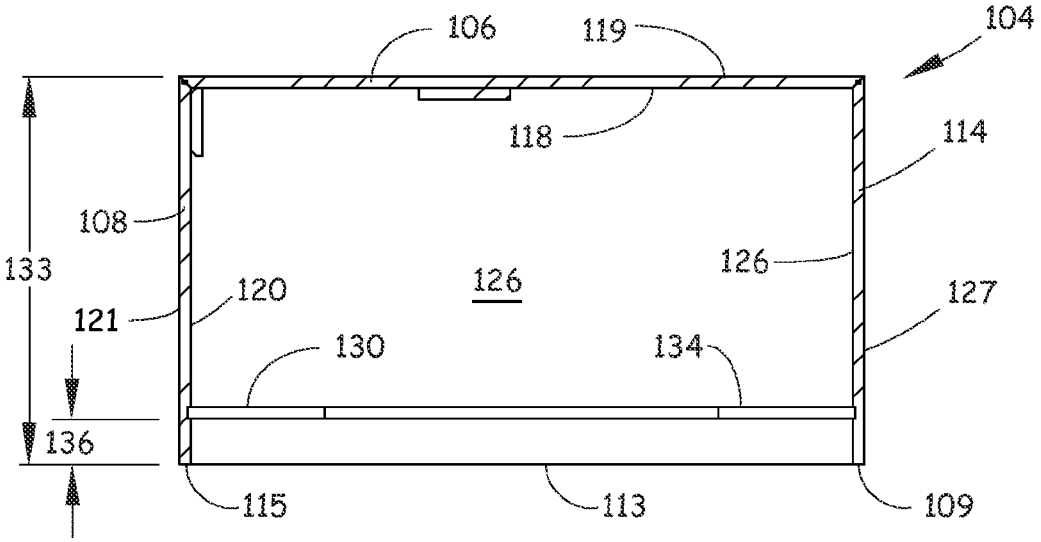
FIG. 5 is a second section view of the upper component or cover of the display unit taken through the line indicated in FIG. 3.
Figure 6:
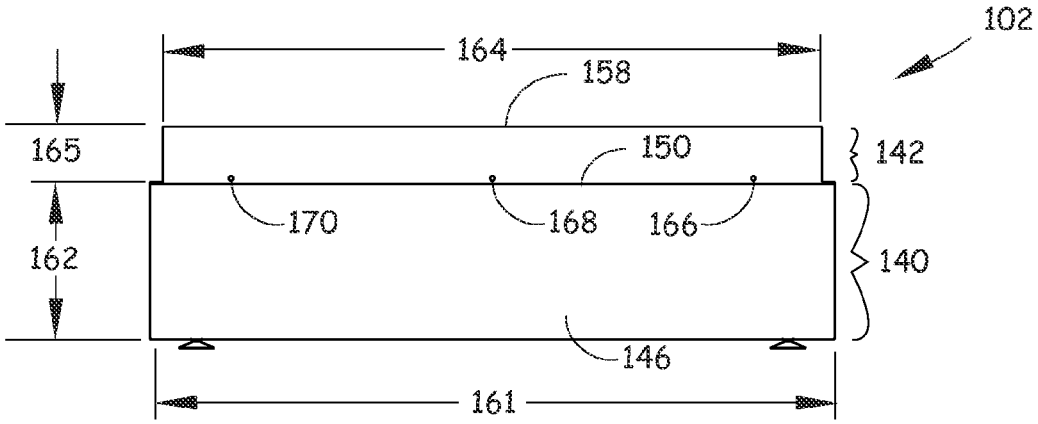
FIG. 6 is a front view of the base frame or four-side pedestal of the display unit illustrated in FIG. 1.

FIG. 1 is an exploded perspective view of a modular display unit or box assembly 100 according to one embodiment. Display unit or box assembly 100 includes a base frame or four-sided pedestal 102 and an upper component or cover 104. Upper component or cover 104 is shown in more detail in FIGS. 2-5, which respectively include a bottom perspective view, a bottom view, a first section view taken through the line indicated in FIG. 3 and a second section view taken through the line indicated in FIG. 3. Base frame or four-side pedestal 102 is shown in more detail in FIG. 6, which is a front view, the back view being substantially identical.

Upper component or cover 104 is made of a single, homogenous material, such as King StarBoard® material. King StarBoard® comes in high density polyethylene sheets that provide a scratch resistant surface, high strength and stiffness and requires less structural support than other like materials. The sheets can be assembled together using standard woodworking tools and then thermoformed or heat welded together to form a single, homogenous component that does not affect the finishing on the sheets.

Upper component or cover 104 includes a top wall or panel 106, four side walls or panels 108, 110, 112 and 114 that together define a length 129, a width 131, a height 133 and a hollow interior 116. Side walls or panels 108, 110, 112 and 114 have bottom edges 109, 111, 113 and 115 that define an opening in a bottom of the cover 104. Hollow interior 116 is defined by interior surfaces 118, 120, 122, 124 and 126 of walls or panels 106, 108, 110, 112 and 114, respectively. Walls or panels 106, 108, 110, 112 and 114 also include exterior surfaces 119, 121, 123, 125 and 127, respectively.

Top wall 106 includes a through hole 135. Through hole 135 is configured to hold a hardware insert called a puck so that a display item, such as a mannequin, can be secured to top wall 106. In one embodiment, the insert includes a threaded hole for receiving a threaded screw that is mounted to the mannequin. Although top wall 106 includes only one through hole 135, it should be realized that any number of through holes in top wall 106 are possible so that more than one mannequin can be secured to top wall 106. Back wall 108 includes a pair of through holes 137 and 138. Through holes 137 and 138 are configured to receive fasteners for fastening a back panel to back wall 108 of cover 104. Such a back panel will be discussed in detail below.

Cover 104 further includes four corner members 128, 130, 132 and 134. Each corner member 128, 130, 132 and 134 has a triangular shape, is coupled to two interior surfaces of the four side panels 108, 110, 112 and 114 and extends inwardly. In particular, each corner member 128, 130, 132 and 134 is coupled to and extends inwardly from a corner of hollow interior 116. Each corner is defined by the abutment of two of the four side panels 108, 110, 112 and 114. For example, first corner member 128 is coupled to interior surface 120 of side wall 108, interior surface 122 of side wall 110 and the corner (i.e., the seam or welded joint) where side wall 108 and side wall 110 abut each other and join. Second corner member 130 is coupled to interior surface 120 of side wall 108, interior surface 124 of side wall 112 and the corner (i.e., the seam or welded joint) where side wall 108 and side wall 112 abut each other and join. Third corner member 132 is coupled to interior surface 122 of side wall 110, interior surface 126 of side wall 114 and the corner (i.e., the seam or welded joint) where side wall 110 and side wall 114 abut each other and join. Fourth corner member 134 is coupled to interior surface 124 of side wall 112, interior surface 126 of side wall 114 and the corner (i.e., the seam or welded joint) where side wall 112 and side wall 114 abut each other and join. In addition, the four corner members 128, 130, 132 and 134 are spaced apart from the free edges 109, 111, 113 and 115 of the four side walls 108, 110, 112 and 114 by a distance 136.

Base frame or four-sided pedestal 102 is made of steel or other like material. Base frame 102 supports cover 104 and includes a lower portion or base portion 140 having an outer periphery and an upper portion or protruding portion 142 having an outer periphery. Lower portion 140 includes four side walls or panels 143, 144, 145 and 146 that have tops or top edges 147, 148, 149 and 150. Upper portion 142 includes four side walls or panels 151, 152, 153 and 154 that have tops or top edges 155, 156, 157 and 158.

Upper portion 142 extends upwardly from tops or top edges 147, 148, 149 and 150 of lower portion 140 and terminates at tops or top edges 156, 157, 158 and 159. The outer periphery of lower portion 140 is defined by a length 160, a width 161 and a height 162. Upper portion 142 also includes an outer periphery and is defined by a length 163, a width 164 and a height 165. Length 163 of upper portion 142 is less than length 160 of lower portion 140 and width 164 of upper portion 142 is less than width 161 of lower portion 140. In other words, the outer periphery of upper portion 142 is recessed from the outer periphery of lower portion 140.

Base frame 102 also includes at least one through hole 168 and at least one opposing through hole 169 that are in alignment with each other. At least one through hole 168 is located on a front side of base frame 102 and at least one through hole 169 is located on a back side of base frame 102. More particularly, at least one through hole 168 is located on front side 154 of upper portion 142 of base frame 102 and at least one through hole 169 is located on back side 151 of upper portion 142 of base frame 102. Through holes 168 and 169 are configured to receive fasteners for attaching base frame 102 to other like base frames 102. In the embodiment illustrated in FIGS. 1 and 6, base frame 102 includes three through holes 166, 168, 170 located on front side 154 of upper portion 142 and in alignment with three through holes 167, 169 and 171 located on back side 151 of upper portion 142. Using through holes 166, 168, 170, 167, 169 and 171 to fasten multiple base frames together will be discussed in detail below.

Figure 7:
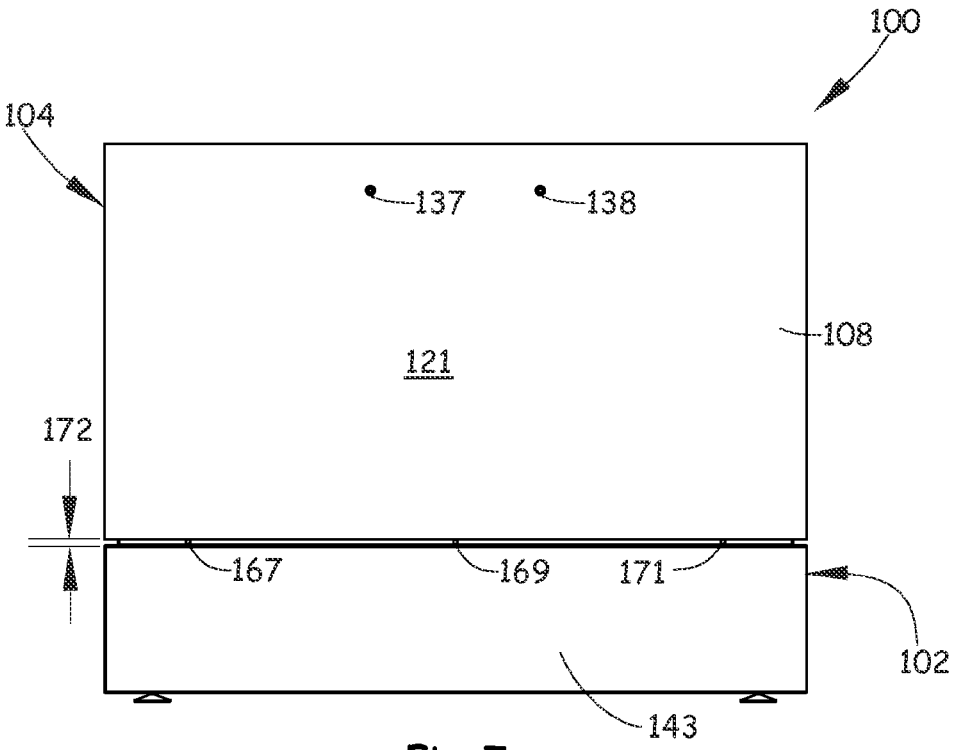
FIG. 7 is a back view of the display unit illustrated in FIG. 1.
Figure 8:
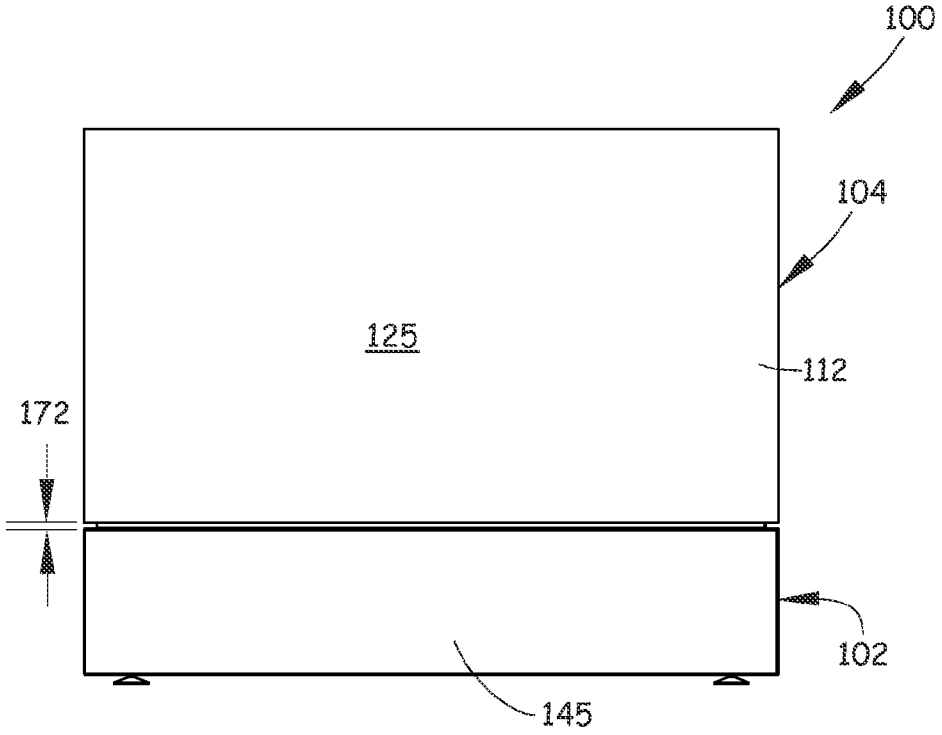
FIG. 8 is a right side view of the display unit illustrated in FIG. 1.
Figure 9:
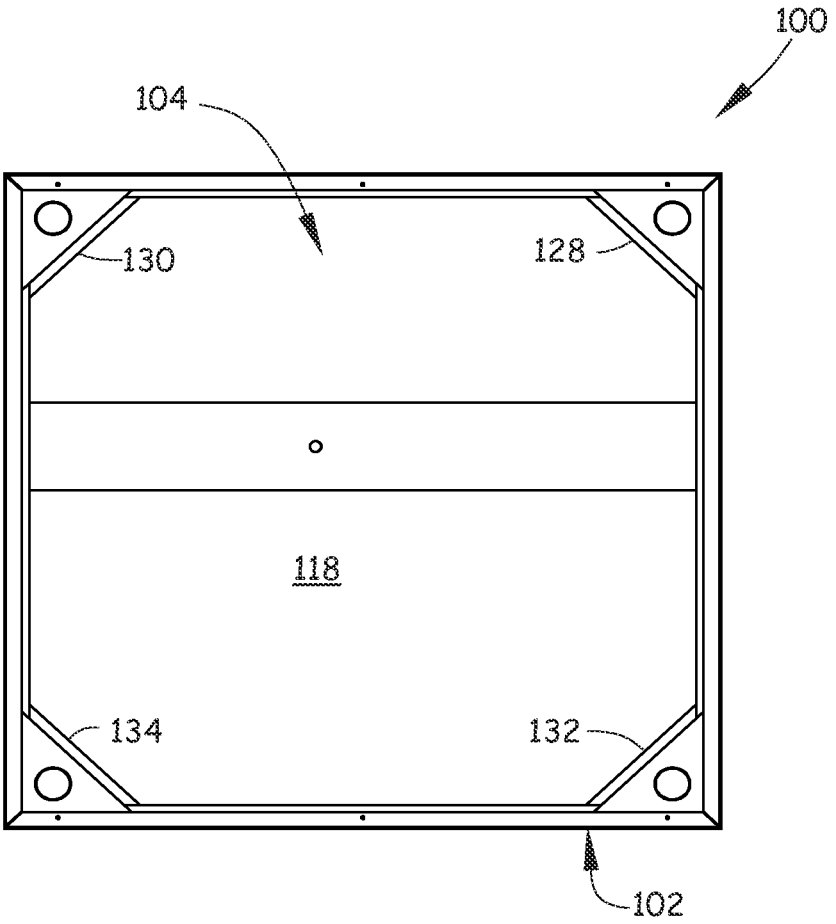
FIG. 9 is a bottom view of the display unit illustrated in FIG. 1.

FIG. 7 is an assembled back view, FIG. 8 is a side view (the opposing side view being identical) and FIG. 9 is a bottom view of display unit or box assembly 100. As illustrated, base frame 102 supports cover 104 so that cover 104 appears to float over the lower portion 140 of base frame 102 by a space 172 or cover 104 is separated form lower portion 140 of base frame 102 by space 172. Space 172 is a distance that is located between bottom edges 109, 111, 113 and 115 of side walls 108, 110, 112 and 114 of cover 104 and tops or top edges 147, 148, 149 and 150 of lower portion 140 of base frame 102.

To create space 172, tops or top edges 155, 156, 157 and 158 of upper portion 142 of base frame 102 engage with corner members 128, 130, 132 and 134 of cover 104 so that cover 104 is supported over lower portion 140 of base frame 102. More specifically, height 165 of upper portion 142 of base frame member 102 is greater than distance 136 between corner members 128, 130, 132, 134 and bottom edges 109, 111, 113, 115 of cover 104. Space 172 that is created exposes a section of the outer periphery of upper portion 142 of base frame 102. In this exposed section of the outer periphery of upper portion 142 of base frame 102 lies through holes 166, 167, 168, 169, 170 and 171. In addition, since length 160 and width 161 of lower portion 140 are substantially the same as length 129 and width 131 of cover 104, the result of supporting cover 104 on base frame 102 makes exterior surfaces 121, 123, 125 and 127 of side walls 108, 110, 112 and 114 of cover 104 be in alignment with the outer periphery of lower portion 140 of base frame 102. Still further, the outer periphery of upper portion 142 of base frame 102 is recessed from exterior surfaces 121, 123, 125 and 127 of side walls 108, 110, 112 and 114 of cover 104 and from the outer periphery of lower portion 140 of base frame 102. The section of the outer periphery of upper portion 142 that is exposed and includes holes 166, 167, 168, 169, 170 and 171 is hidden or blocked from view by the outer periphery of cover 104 and lower portion 140 of base frame 102.

Figure 10:
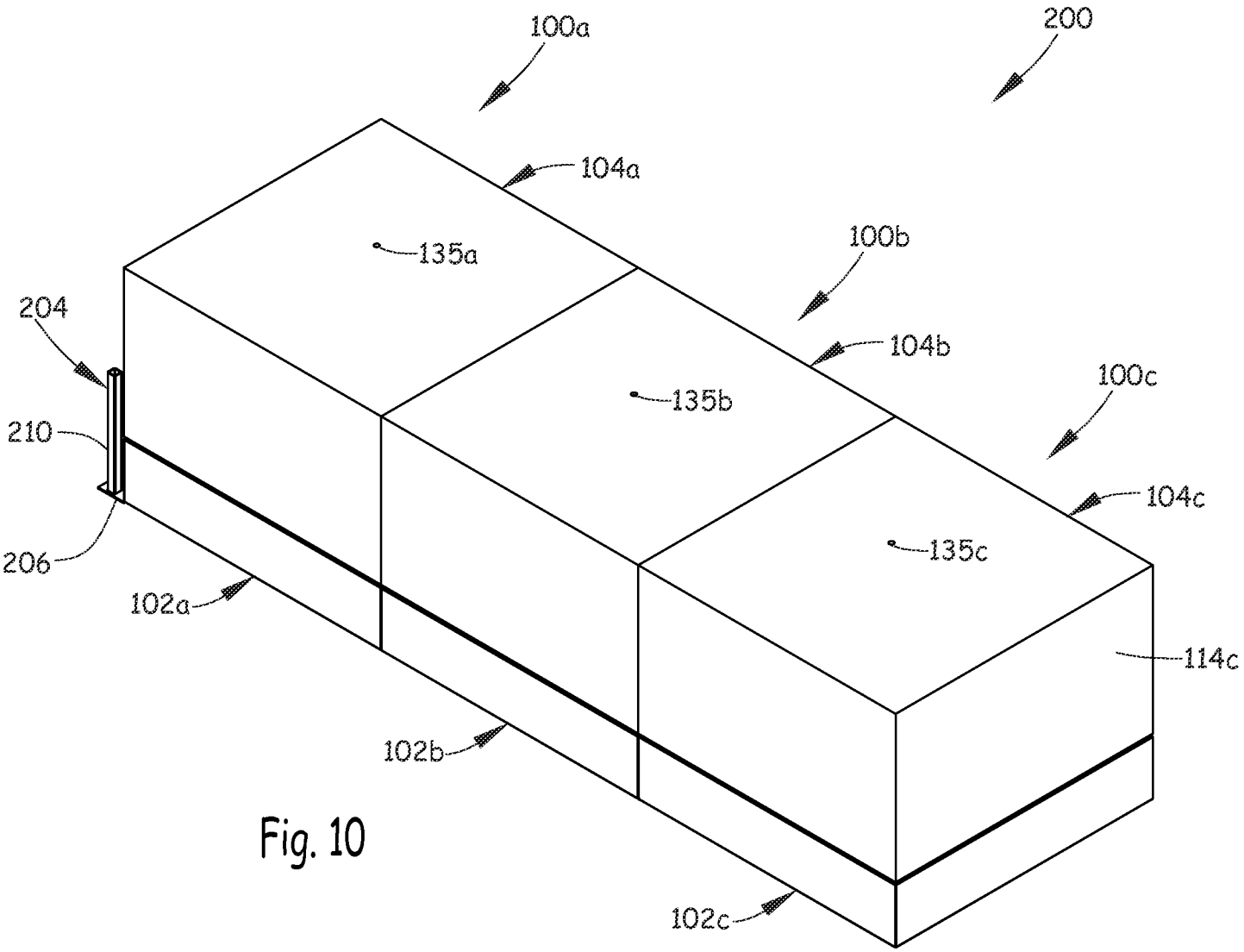
FIG. 10 illustrates a front perspective view of a plurality of display units coupled together to form a runway for holding a plurality of display items, such as mannequins, according to one embodiment.
Figure 11:
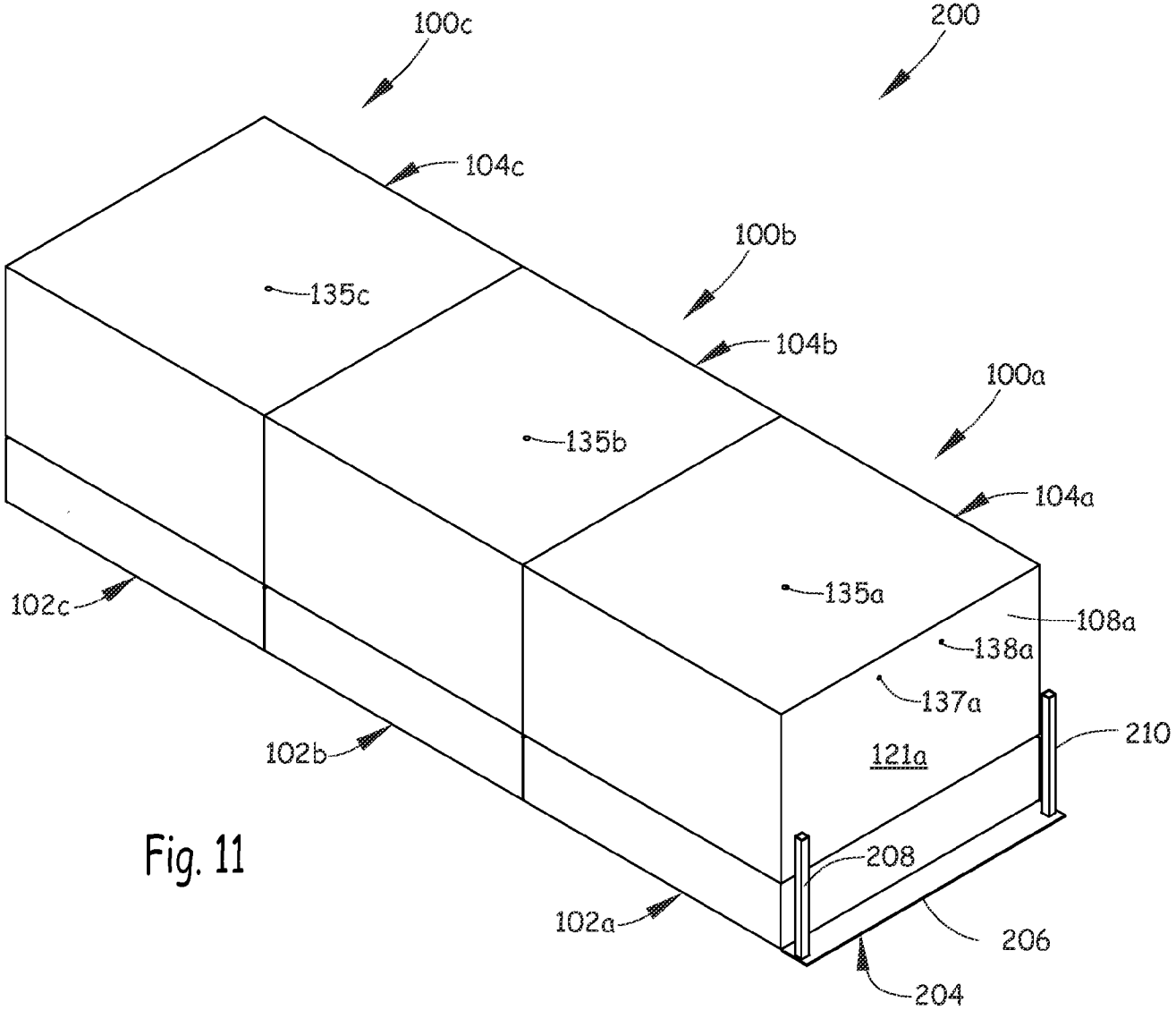
FIG. 11 illustrates a back perspective view of the plurality of display units illustrated in FIG. 10.
Figure 12:
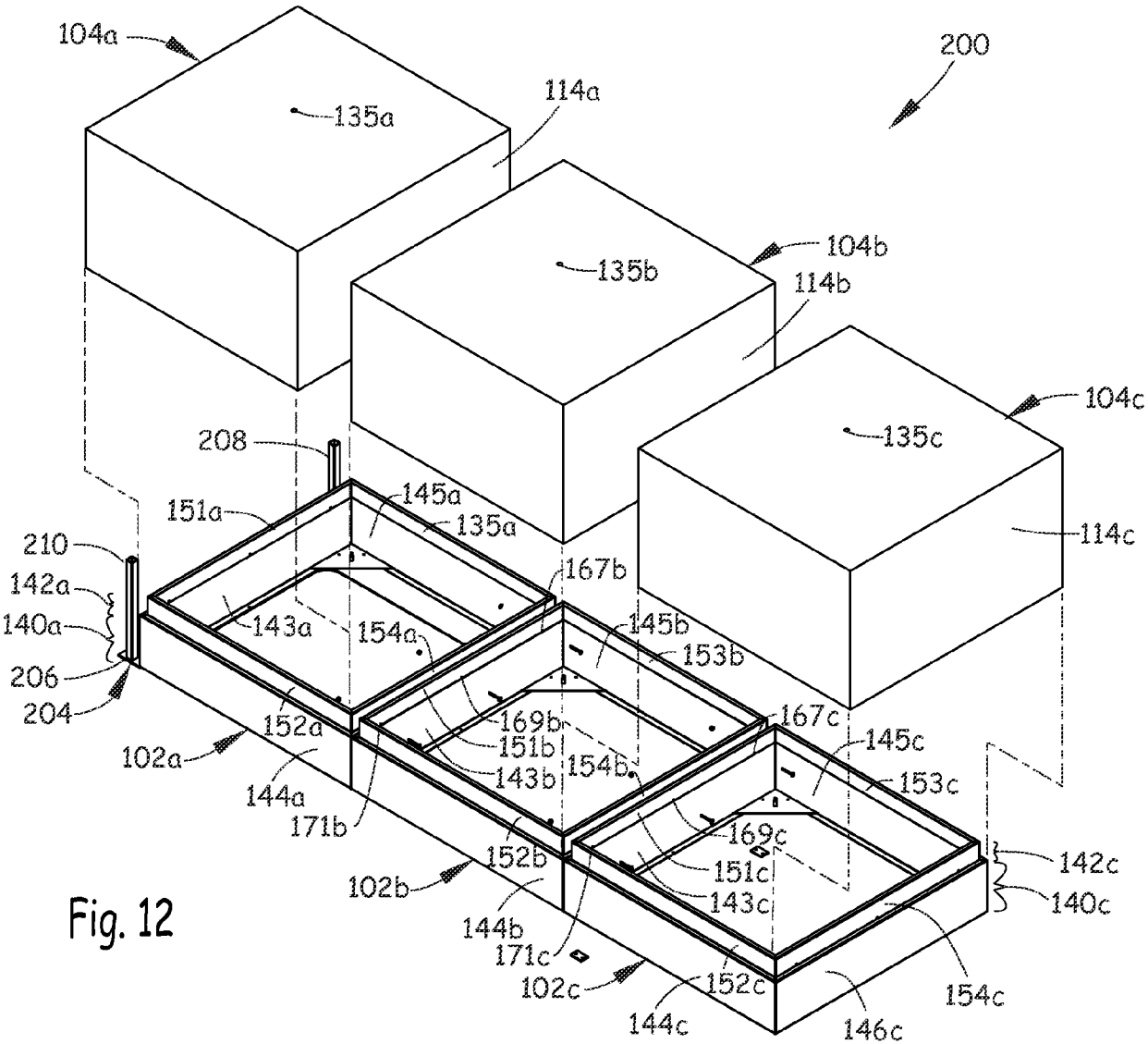
FIG. 12 illustrates a front exploded perspective view of the plurality of display units illustrated in FIG. 10.
Figure 13:
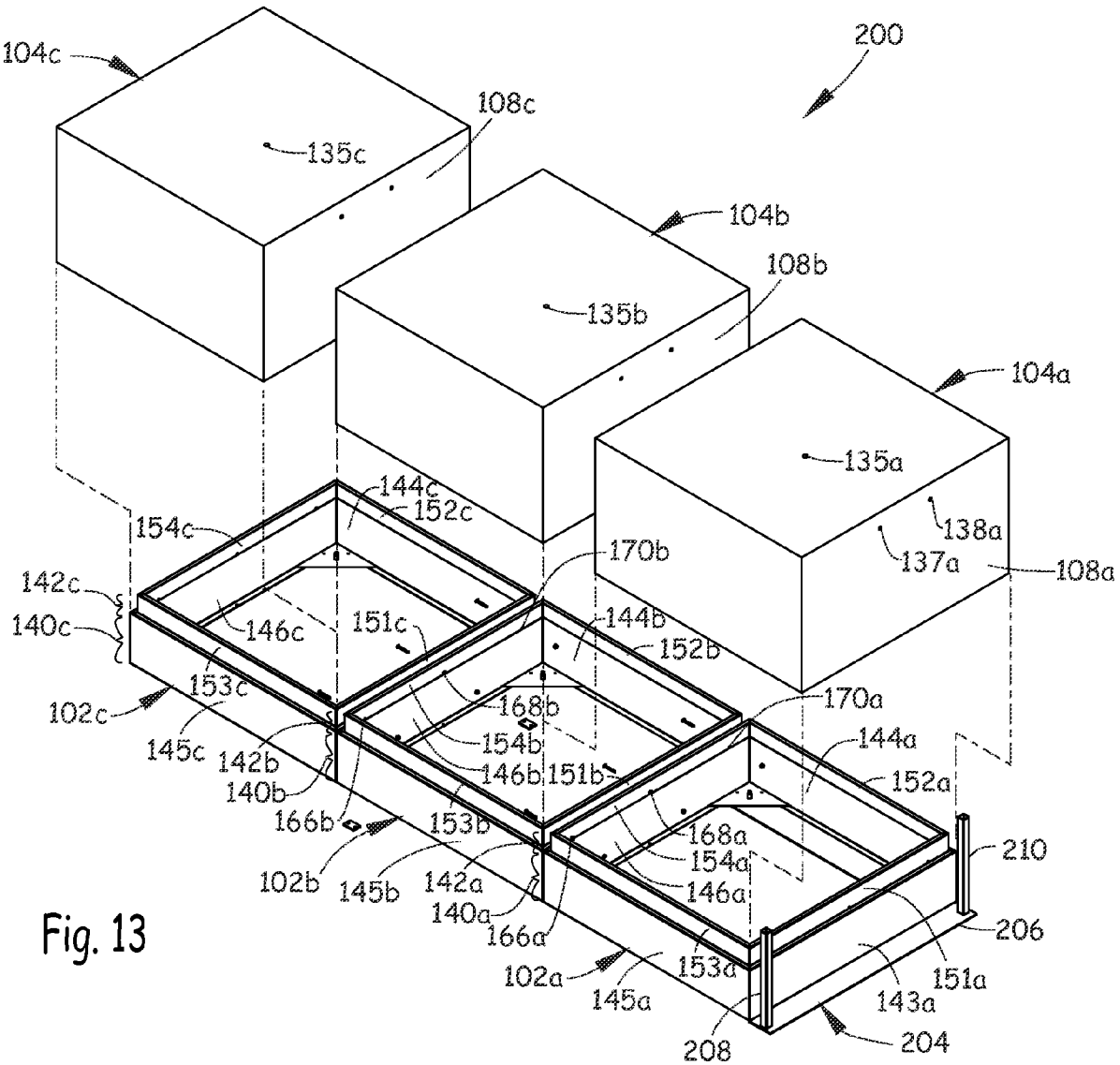
FIG. 13 illustrates a back exploded perspective view of the plurality of display units illustrated in FIG. 10.
Figure 14:
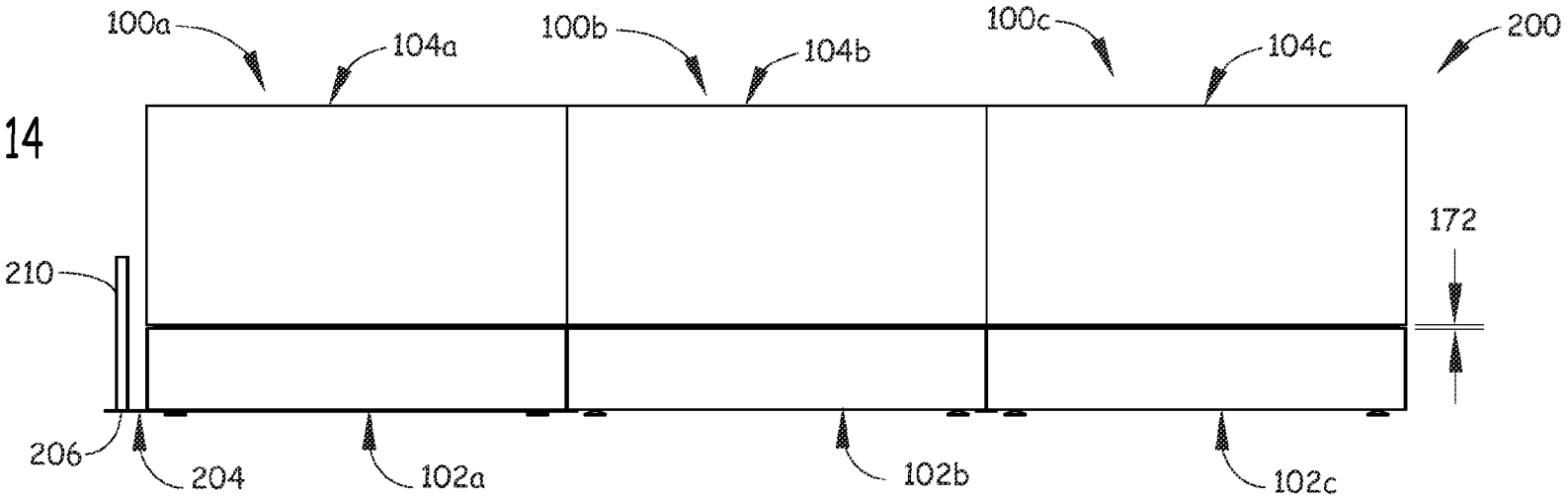
FIG. 14 is a left side view of the plurality of display units illustrated in FIG. 10.
Figure 15:
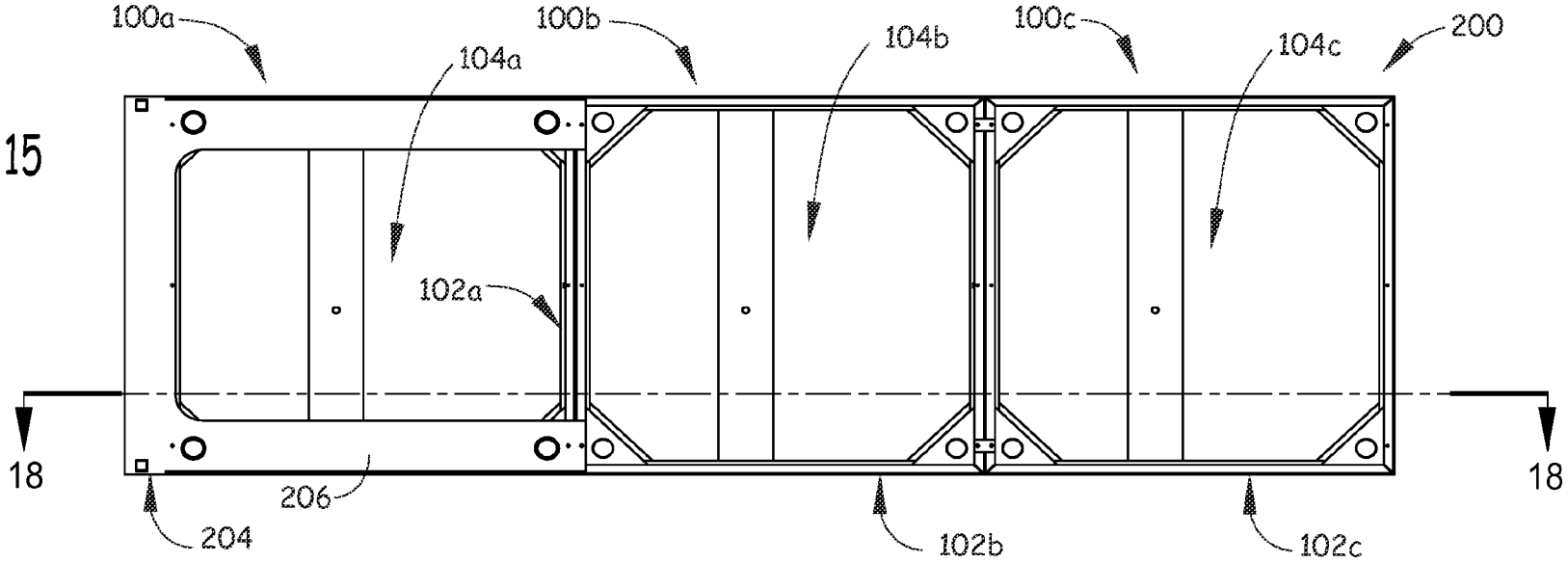
FIG. 15 is a bottom view of the plurality of display units illustrated in FIG. 10.
Figure 16:
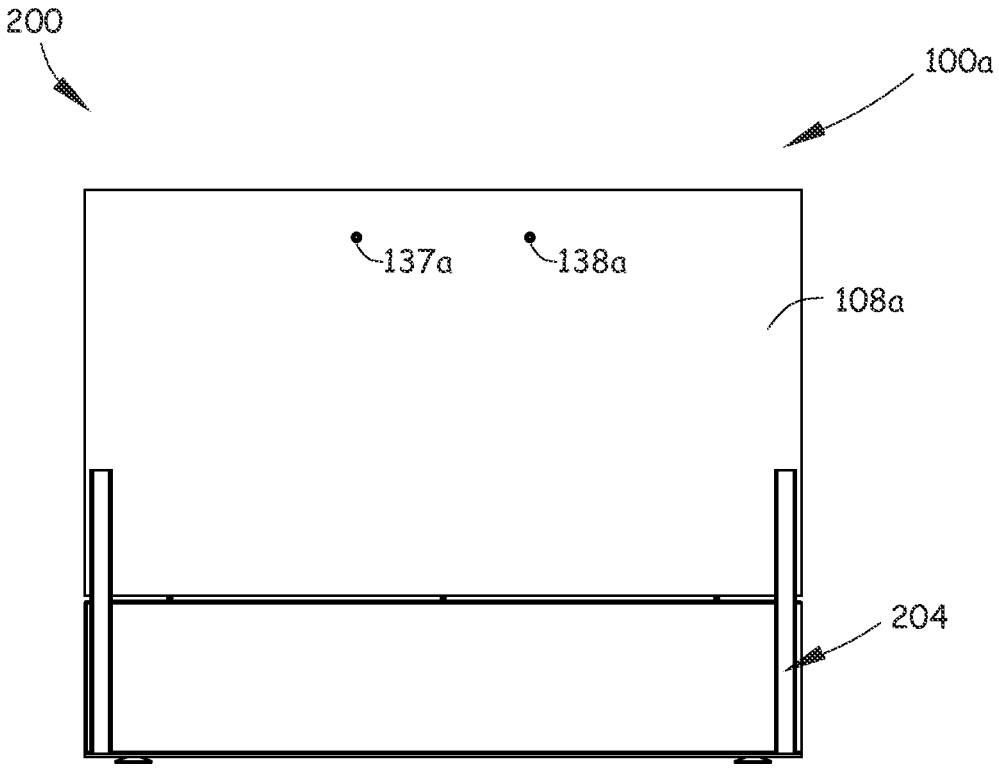
FIG. 16 is a back view of the plurality of display units illustrated in FIG. 10.
Figure 17:
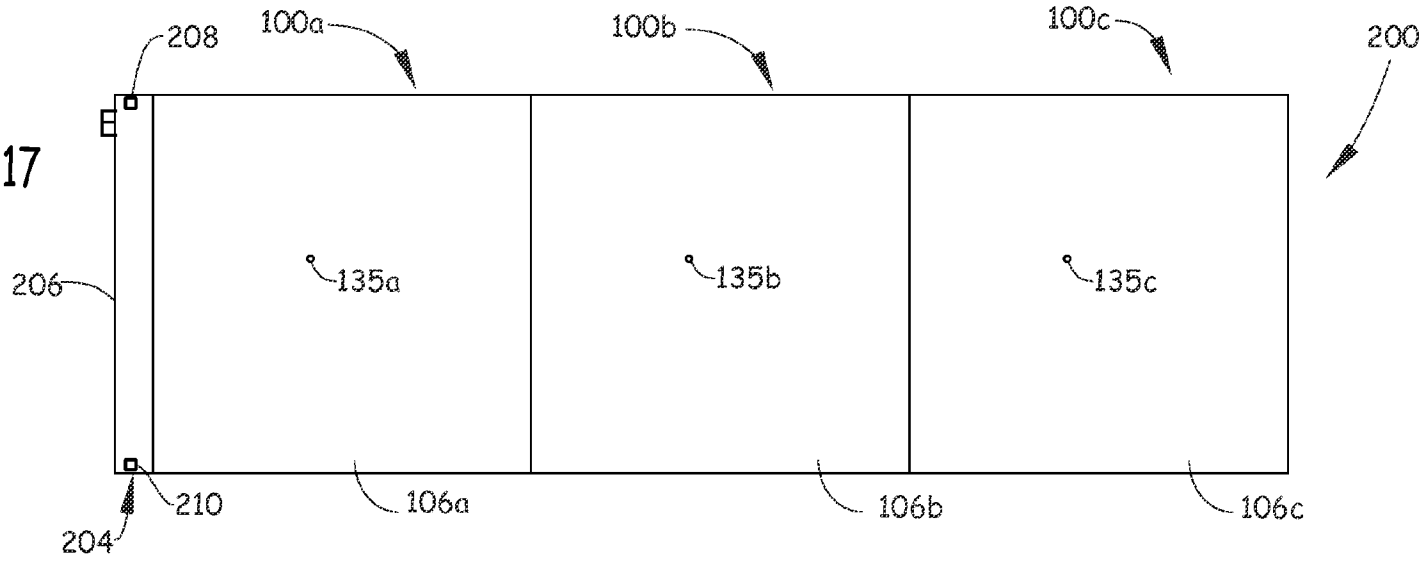
FIG. 17 is a top view of the plurality of display units illustrated in FIG. 10.
Figure 18:
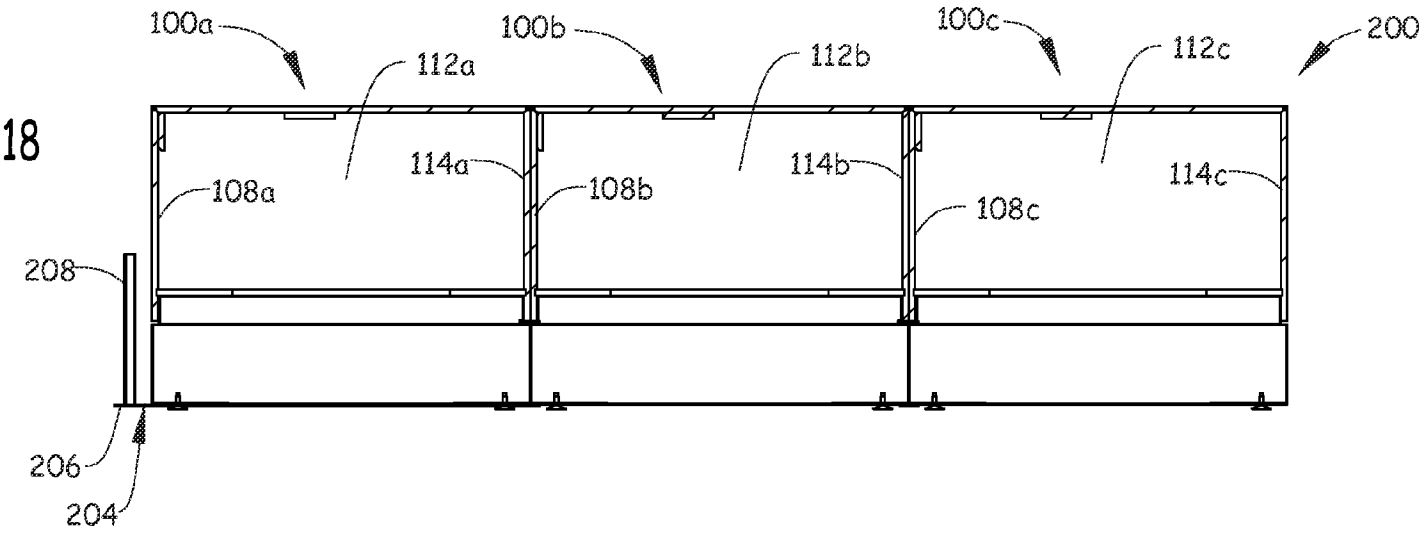
FIG. 18 is a section view of the plurality of display units illustrated in FIG. 10 and as taken through the line indicated in FIG. 15.
Figure 19:
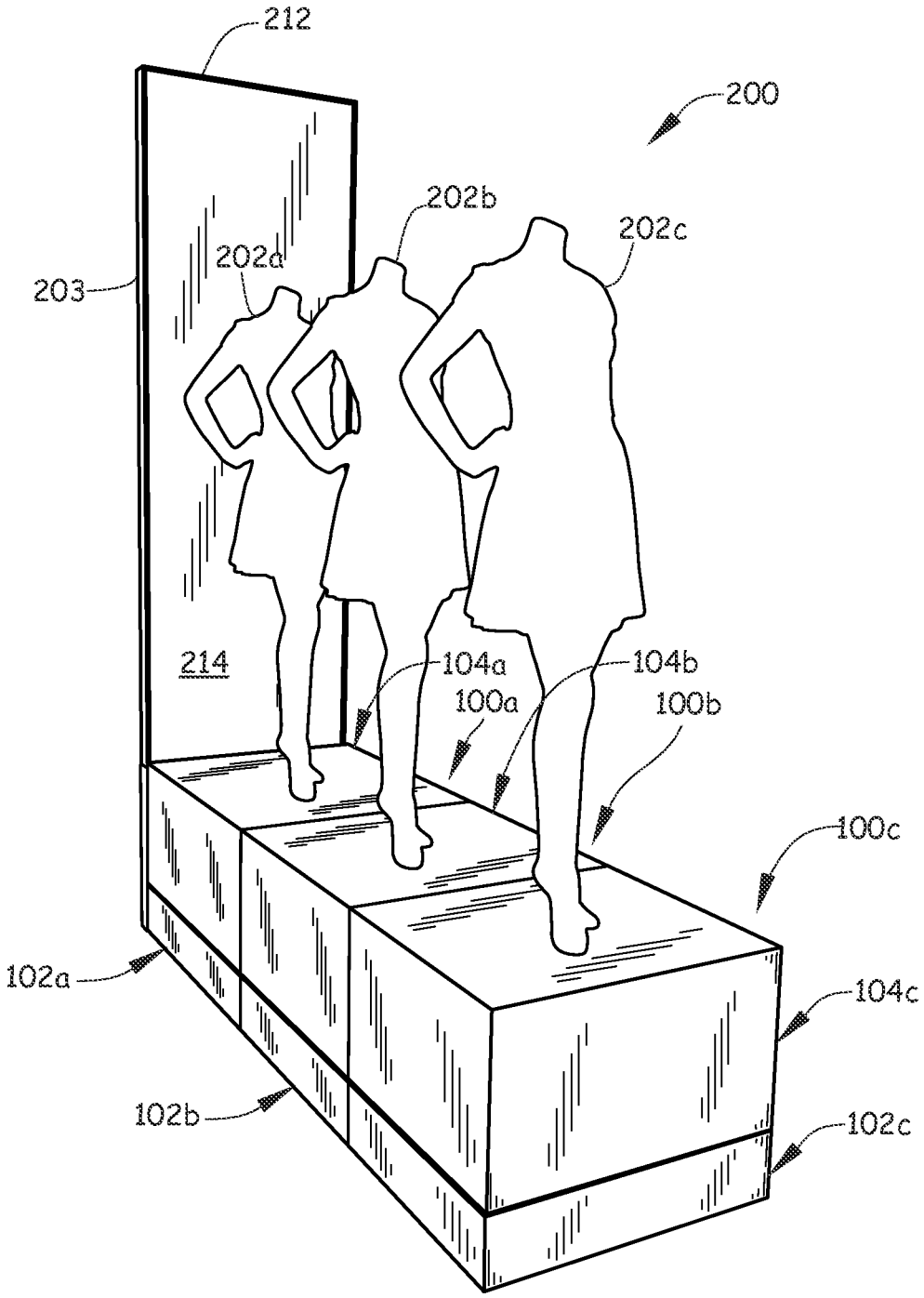
FIG. 19 is a perspective view of the plurality of display units illustrating components to which the plurality of display units support.

FIG. 10 illustrates a front perspective view of a plurality of display units 100*a*, 100*b* and 100*c* coupled together to form an elevated runway 200 for holding a plurality of display items, such as mannequins, according to one embodiment. FIG. 11 illustrates a back perspective view, FIG. 12 illustrates a front exploded perspective view, FIG. 13 illustrates a back exploded perspective view, FIG. 14 illustrates a left side view (the right side view being substantially identical), FIG. 15 illustrates a bottom view, FIG. 16 illustrates a back view and FIG. 17 illustrates a top view of the plurality of display units 100*a*, 100*b* and 100*c* coupled together into runway 200. FIG. 18 illustrates a section view of runway 200 taken through the line indicated in FIG. 15. In addition, FIG. 19 is a perspective view of the plurality of display units 100*a*, 100*b* and 100*c* supporting mannequins 202*a*, 202*b* and 202*c* and a back panel 203.

Modular display units or box assemblies 100*a*, 100*b* and 100*c* are substantially identical to each other and are each substantially identical to exemplary display unit or box assembly 100 illustrated in FIGS. 1-9. As described, display units 100*a*, 100*b* and 100*c* are attached together to form an elevated runway 200 for displaying, holding or otherwise retaining display items, such as mannequins. Each display unit 100*a*, 100*b* and 100*c* is attached to at least one other display unit 100*a*, 100*b* or 100*c* using at least one fastener that is inserted into two aligned through holes in two different display units. The two aligned through holes are located in the space between the covers and the lower portions of the base frames.

FIGS. 10-18 illustrate display unit 100*a* including base frame or four-sided pedestal 102*a* and cover or upper component 104*a*, display unit 100*b* including base frame or four-sided pedestal 102*b* and cover or upper component 104*b* and display unit 100*c* including base frame or four-side pedestal 102*c* and cover or upper component 104*c*. Display units 100*a*, 100*b* and 100*c* are located adjacent to each other so that one side of one of the base frames of one of the display units is adjacent to one side of another of the base frames of another of the display units. For example and as illustrated in FIGS. 12 and 13, side wall or panel 146*a* of lower portion 140*a* faces and is adjacent to side wall or panel 143*b* of lower portion 140*b* such that side wall or panel 154*a* of upper portion 142*a* faces and is adjacent to side wall or panel 151*b* of upper portion 142*b*. Side wall or panel 146*b* of lower portion 140*b* faces and is adjacent to side wall or panel 143*c* of lower portion 140*c* such that side wall or panel 154*b* of upper portion 142*b* faces or is adjacent to side wall or panel 151*c* of upper portion 142*c*. In particular, through holes 166*a*, 168*a* and 170*a* in base frame 102*a* are aligned with through holes 167*b*, 169*b* and 171*b* in base frame 102*b*, respectively, and through holes 166*b*, 168*b* and 170*b* in base frame 102*b* are aligned with through holes 167*c*, 169*c* and 171*c* in base frame 102*c*, respectively.

As illustrated in FIGS. 12 and 13, fasteners fasten base frame 102*a* to base frame 102*b* and fasten base frame 102*b* to base frame 102*c* using the aligned through holes. Each exploded fastener illustrated in FIGS. 12 and 13 consists of a threaded screw and nut. After each fastener is assembled within the aligned holes and with reference back to FIGS. 10 and 11 and to FIGS. 14-18, covers 104*a*, 104*b* and 104*c* are placed on top of base frames 102*a*, 102*b* and 102*c*, respectively. Each of the four corner members on each of covers 104*a*, 104*b* and 104*c* rest on the top edges of the upper portions of each base frame 102*a*, 102*b* and 102*c* to create space 172. Space 172 being the section of the upper portion of each base frame that includes the through holes for receiving the fasteners that hold the base frames 102*a*, 102*b* and 102*c* together. Space 172 both accommodates the assembled fasteners and at the same time hides the unused holes on the front of runway 200 so that the unused holes do not detract from the overall appearance. In addition, when only one display unit is being used, space 172 also hides the unused holes on all sides of the display unit so that the unused holes do not detract from the overall appearance.

As previously discussed each top wall or panel 106*a*, 106*b* and 106*c* in each box assembly 100*a*, 100*b* and 100*c* in runway 200 includes at least one through hole 135*a*, 135*b* and 135*c*. Through holes 135*a*, 135*b* and 135*c* house a hardware insert, called a puck, so that a display item, such as a mannequin, can be secured to each top wall 106*a*, 106*b* and 106*c*.

FIG. 19 is a perspective view of the plurality of display units 100*a*, 100*b* and 100*c* of runway 200 illustrating mannequins 202*a*, 202*b* and 202*c* attached to the top walls or panels 106*a*, 106*b* and 106*c*. As illustrated, when mannequins 202*a*, 202*b* and 202*c* are mounted to their respective display units 100*a*, 100*b* and 100*c*, the mannequins appear to be on a fashion runway. Each mannequin 202*a*, 202*b* and 202*c* can be outfitted with merchandise for displaying to customers in a retail store.

With reference back to FIGS. 10-18, runway 200 also includes a panel support 204. Panel support 204 includes a base 206 and mounting components, such as a pair of protruding legs 208 and 210. As illustrated in FIGS. 13 and 15, base 206 is a u-shaped plate that is attached to and extends along the bottoms of side walls or panels 143*a*, 144*a* and 145*a* of lower portion 140*a* of base frame 102*a*. A portion of base 206 that extends along the bottom of back wall or panel 143*a* of lower portion 140*a* of base frame 102*a* protrudes from back panel 143*a* to hold the mounting components, such as the pair of protruding legs 208 and 210. The pair of protruding legs 208 and 210 are configured to receive a display element, such as a decorative panel or scrim to add to the appearance of display unit 100*a*, 100*b* and 100*c* being a runway 200.

With reference to FIG. 19, legs 208 and 210 receive back panel 203. Back panel 203 extends from base 206 and includes a distal end 212 and a front surface 214. Front surface 214 of back panel 203 faces and is adjacent to side wall 143*a* of lower portion 140*a* of base frame 102*a* and faces and is adjacent to exterior surface 121*a* of side wall 108*a* of cover 104*a*. Distal end 212 is located above the heads of mannequins 202*a*, 202*b* and 202*c*. Together the position and the height of back panel 203 adds to the appearance of runway 200. To further secure back panel 203 to runway 200, fasteners are inserted through back panel 203 and into holes 137*a* and 138*a* in cover 142*a*.

FIGS. 1-9 illustrate a single display unit or box assembly 100. As such and in one embodiment, a retail store can display a single display unit or box assembly including attaching a single or multiple mannequins to the top wall of the display unit. FIGS. 10-19 illustrates three display units or box assemblies 100*a*, 100*b* and 100*c*. As such and in one embodiment, a retail store can display three display units or box assemblies in a line including attaching a single or multiple mannequins to each top wall of each display unit. However, it should be realized that since display unit 100 is modular, any number of display units or box assemblies 100 can be attached in a line together to form longer runways or shorter runways. In these embodiments, the runway is one display unit wide and multiple display units in length.

In still other embodiments, each base frame can include through holes located on each side wall of the upper portion. In this way, display units or box assemblies 100 can be attached together so that the elevated platform is multiple display units wide and multiple display units long. In this embodiment, a retail store can attach a single or multiple mannequins to each top wall of each display unit.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a plurality of substantially identical box assemblies attached together to form an elevated runway for displaying mannequins, each box assembly comprises:

a cover including a top wall, four side walls having bottom edges that define an opening in a bottom of the cover, a hollow interior and corner members, each corner member being directly attached to interior surfaces of two of the four side walls;

a four-sided pedestal including a base portion having an inner periphery and an outer periphery with a perimeter and a protruding portion that protrudes upwardly from the base portion and having an inner periphery and an outer periphery with a perimeter that is less than the perimeter of the outer periphery of the base portion, wherein the protruding portion engages with the corner members to support the cover so that the cover is located entirely above and separated from the base portion of the four-sided pedestal by a space; and wherein each box assembly is attached to at least one other box assembly using at least one fastener that is inserted through the space between the cover and the base portion of the four-sided pedestal of each box assembly and into at least one hole in the protruding portion of the four-sided pedestal.

2. The display fixture of claim 1, wherein the cover comprises a single, homogenous material.

3. The display fixture of claim 1, wherein the base portion of the four-sided pedestal comprises a length, a width and a height and wherein the protruding portion of the four-sided pedestal protrudes from a top of the base portion to a top of the protruding portion, the protruding portion having a length that is less than the length of the base portion, a width that is less than the width of the base portion and a height.

4. The display fixture of claim 3, wherein the space between the base portion of the four-sided pedestal and the cover comprises a distance between the bottom edges of the four side walls of the cover and the top of the base portion of the four-sided pedestal.

5. The display fixture of claim 3, wherein each corner member is coupled to and extends inwardly from one of four corners of the hollow interior, wherein each corner is defined by the abutment of two of the four side walls.

6. The display fixture of claim 1, wherein the four corner members are spaced apart from the bottom edges of the four sides of the cover by a distance.

7. The display fixture of claim 6, wherein the height of the protruding portion of the pedestal is greater than the distance between the four corner members and the bottom edges of the four sides of the cover to provide the space between the cover and the base portion of the pedestal.

8. The display fixture of claim 1, wherein the top wall of the cover comprises at least one through hole for receiving an insert for securing a mannequin to the top wall of the cover.

9. A display unit comprising:

an upper component including a top panel, four side panels having bottom edges that define an opening in a bottom of the upper component, interior surfaces that define a hollow interior and exterior surfaces;

a base frame including a lower portion having an outer periphery and an inner periphery and an upper portion that extends upwardly from a top of the lower portion and having an outer periphery and an inner periphery, wherein a perimeter of the outer periphery of the lower portion is greater than a perimeter of the outer periphery of the upper portion; and four corner members coupled to and extending inwardly from the interior surfaces of the upper component and positioned at a distance from the bottom edges of the four side panels, each corner member being directly attached to the interior surfaces of two of the four side panels; and wherein the four corner members engage with a top of the upper portion of the base frame such that the bottom edges of the four side panels of the upper component are free and are vertically spaced apart from and located entirely above the top of the lower portion of the base frame to expose a section of the outer periphery of the upper portion of the base frame to an exterior of the display unit.

10. The display unit of claim 9, wherein the exterior surfaces of the four side walls of the upper component are in alignment with the outer periphery of the lower portion of the base frame.

11. The display unit of claim 10, wherein the outer periphery of the upper portion of the base frame is recessed from the outer periphery of the lower portion of the base frame and from the exterior surfaces of the four side walls of the upper component.

12. The display unit of claim 9, wherein each of the plurality of corner members has a triangular shape and is mounted to an interior of the upper component at one of four corners of the upper component, wherein each corner of the upper component is defined by the abutment of two of the four side walls.

13. The display unit of claim 9, wherein the upper portion of the base frame comprises at least one through hole for receiving a fastener and is located in the section of the upper portion that is exposed to the exterior of the display unit.

14. The display unit of claim 9, wherein the upper component comprises a single, homogeneous material.

15. The display unit of claim 9, wherein the top panel of the upper component comprises at least one hole that extends between the interior surface and the exterior surface to receive mounting hardware for supporting a display item.

16. A display fixture comprising:

a plurality of four-sided pedestals located adjacent to each other so that a side of one of the four-sided pedestals is adjacent to a side of another of the four-side pedestals, wherein each of the four-sided pedestals comprise:

a lower portion having an outer periphery;

an upper portion that extends upwardly from a top of the lower portion and having an outer periphery;

a plurality of fasteners that fasten the plurality of four-sided pedestals together by inserting each fastener into holes located in a section of the upper portion of each four-sided pedestal;

a plurality of covers placed on top of the plurality of four-sided pedestals to form a runway, wherein each cover includes a top wall, four side walls having bottom edges that define an opening in a bottom of the cover and a hollow interior; and at least one mannequin attached to the top wall of each cover using at least one through hole located in the top wall; and wherein the upper portion of each four-sided pedestal supports one of the covers so that each cover is spaced apart from the lower portion of each four-sided pedestal by a distance, the distance being the section of the upper portion of each four-side pedestal that includes the holes for the fasteners.

17. The display fixture of claim 16, further comprising a panel support mounted to a bottom of one of the four-sided pedestals located at an end of the runway such that a portion of the panel support protrudes from a back side of the one of the four-sided pedestals and includes mounting components.

18. The display fixture of claim 17, further comprising a back panel attached to the mounting components on the panel support such that the back panel is adjacent to the back side of the one of the four-sided pedestals and adjacent to a back side of the corresponding cover that is on the one of the four-sided pedestals, wherein the back panel is fastened to the back side of the corresponding cover with fasteners.

* * * * *